US012768269B2

(12) United States Patent
Ghassal et al.

(10) Patent No.: US 12,768,269 B2
(45) Date of Patent: Oct. 20, 2026

(54) METHOD AND SYSTEM FOR FORMATION PORE PRESSURE PREDICTION PRIOR TO AND DURING DRILLING

(71) Applicant: SAUDI ARABIAN OIL COMPANY, Dhahran (SA)

(72) Inventors: Bandar Ismail Ghassal, Dhahran (SA); Fatai A. Anifowose, Al-Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 1149 days.

(21) Appl. No.: 17/809,831

(22) Filed: Jun. 29, 2022

(65) Prior Publication Data

US 2024/0003250 A1 Jan. 4, 2024

(51) Int. Cl.
*E21B 49/00* (2006.01)
*E21B 44/00* (2006.01)

(52) U.S. Cl.
CPC ..... *E21B 49/005* (2013.01); *E21B 44/00* (2013.01); *E21B 2200/20* (2020.05); *E21B 2200/22* (2020.05)

(58) Field of Classification Search
CPC .... E21B 49/005; E21B 44/00; E21B 2200/20; E21B 2200/22; E21B 49/00
See application file for complete search history.

(56) References Cited

U.S. PATENT DOCUMENTS 11,261,730 B2 3/2022 AlBahrani et al.
2011/0088895 A1 4/2011 Pop et al.
2014/0116776 A1* 5/2014 Marx ..... E21B 12/02 706/11

(Continued)

FOREIGN PATENT DOCUMENTS

CN 113396341 A * 9/2021 ..... G01V 1/42
WO WO-2015073017 A1 * 5/2015 ..... G05B 13/0265

(Continued)

OTHER PUBLICATIONS

Fuzzy logic-driven and SVM-driven hybrid computational intelligence models applied to oil and gas reservoir characterization (Year: 2011).*

(Continued)

*Primary Examiner* — Chuen-Meei Gan
(74) *Attorney, Agent, or Firm* — Osha Bergman Watanabe & Burton LLP

(57) ABSTRACT

A method for facilitating drilling of a prospect involves, for a multitude of offset wells associated with the prospect, obtaining offset well data, the offset well data including surface drilling parameters, mud gas data, and formation pore pressure data. The method further involves training, using the offset well data, a machine learning (ML) model to make formation pore pressure predictions, where the offset well data used for training the ML model excludes the offset well data of an offset well in closest proximity to the prospect. The method also involves generating a formation pore pressure profile prediction for the prospect prior to drilling the prospect by making formation pore pressure predictions for the offset well in closest proximity to the prospect using the ML model operating on the offset well data of the offset well in closest proximity to the prospect.

12 Claims, 7 Drawing Sheets

(56) References Cited

U.S. PATENT DOCUMENTS

| | | | | |
|---|---|---|---|---|
| 2016/0222741 | A1* | 8/2016 | Lovorn | E21B 34/00 |
| 2017/0260855 | A1 | 9/2017 | Yang et al. | |
| 2020/0333505 | A1 | 10/2020 | Yan et al. | |
| 2021/0348495 | A1 | 11/2021 | Anifowose et al. | |
| 2021/0349001 | A1 | 11/2021 | Anifowose et al. | |
| 2022/0075915 | A1 | 3/2022 | Vallabhaneni et al. | |

FOREIGN PATENT DOCUMENTS

| | | | | |
|---|---|---|---|---|
| WO | WO-2017135972 | A1 * | 8/2017 | E21B 43/00 |
| WO | 2020185094 | A1 | 9/2020 | |
| WO | 2020191360 | A1 | 9/2020 | |
| WO | WO-2022067320 | A1 * | 3/2022 | E21B 41/00 |

OTHER PUBLICATIONS

Office Action issued in Saudi Arabian Application No. 123447411, mailed on Mar. 10, 2025 (9 pages).

* cited by examiner

METHOD AND SYSTEM FOR FORMATION PORE PRESSURE PREDICTION PRIOR TO AND DURING DRILLING

BACKGROUND

Formation pore pressure is an important variable for drilling operations. For example, knowing the formation pore pressure ahead of a drilling campaign may help the drilling crew choose the right mud weight to use to ensure safety and preserve the wellbore integrity. Overpressures can cause kicks, blowouts, and borehole instability during drilling leading to risks to human lives and a considerable increase in the cost of drilling. Preparing an efficient drilling plan may be difficult without an accurate pore pressure prediction. The current approach to formation pore pressure prediction ahead of drilling a prospect is heavily reliant on seismic data and wireline logs from offset wells. However, seismic data is known for its low vertical resolution. A more recent seismic-while-drilling approach is costly, and accuracy is still not guaranteed due to the inherent noise in seismic data. Seismic data has high uncertainties due to the low vertical resolution while wireline data is only acquired after drilling is completed, hence could not serve the real-time purpose required for this application. In view of the above, the availability of accurate formation pore pressure predictions would be desirable.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a method for facilitating drilling of a prospect, the method comprising: for a plurality of offset wells associated with the prospect, obtaining offset well data, the offset well data comprising: surface drilling parameters, mud gas data, and formation pore pressure data; training, using the offset well data, a machine learning (ML) model to make formation pore pressure predictions, wherein the offset well data used for training the ML model excludes the offset well data of an offset well in closest proximity to the prospect; and generating a formation pore pressure profile prediction for the prospect prior to drilling the prospect by: making formation pore pressure predictions for the offset well in closest proximity to the prospect using the ML model operating on the offset well data of the offset well in closest proximity to the prospect.

In general, in one aspect, embodiments relate to a non-transitory machine-readable medium comprising a plurality of machine-readable instructions executed by one or more processors, the plurality of machine-readable instructions causing the one or more processors to perform operations comprising: for a plurality of offset wells associated with a prospect, obtaining offset well data, the offset well data comprising: surface drilling parameters, mud gas data, and formation pore pressure data; training using the offset well data, a machine learning (ML) model to make formation pore pressure predictions, wherein the offset well data used for training the ML model excludes the offset well data of an offset well in closest proximity to the prospect; and generating a formation pore pressure profile prediction for the prospect prior to drilling the prospect by: making formation pore pressure predictions for the offset well in closest proximity to the prospect using the ML model operating on the offset well data of the offset well in closest proximity to the prospect.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
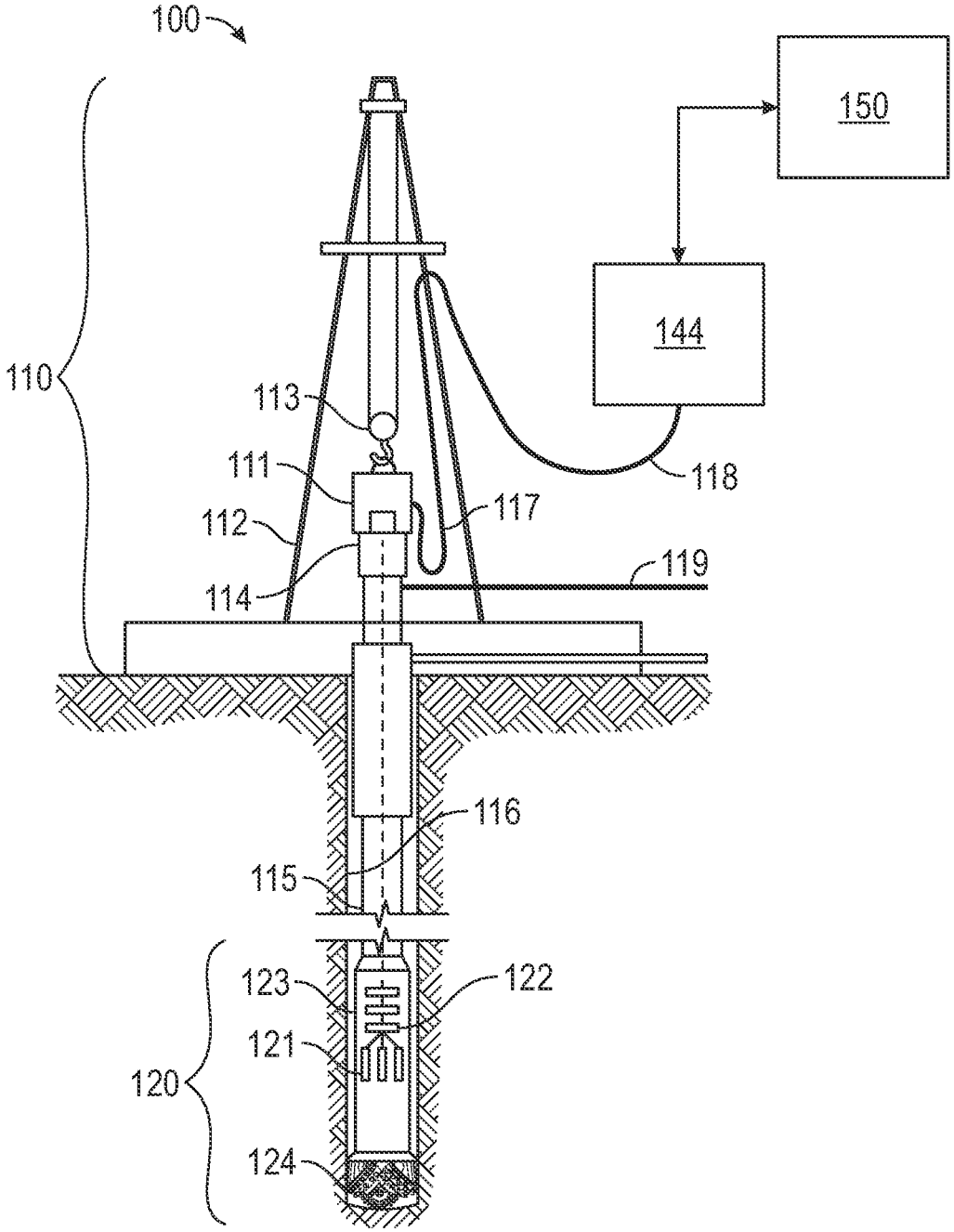
FIG. 1 shows a system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for a formation pore pressure prediction prior to and during drilling of a prospect. The prospect may be a well to be drilled at a drilling location. The drilling location may be in an area of exploration in which hydrocarbons are assumed to exist in an economic quantity.

The prediction prior to the drilling may be performed based on surface drilling parameters and mud gas data previously collected from offset wells, and the updating of the prediction during the drilling may be performed using real-time data obtained from the well being drilled.

Methods and systems in accordance with embodiments of the disclosure provide non-seismic alternatives to determining formation pore pressure, based on mud gas data. The gas liberated during drilling (measured as mud gas data) may have a high correlation with drilling hazards such as kicks and blowouts. These hazards are attributable to formation overpressure, which may be detectable using embodiments of the disclosure. Embodiments of the disclosure operate in two major steps:

(1) Mud gas data may be collected from offset wells along with their respective formation pore pressure values from D-Exponent (an extrapolation of certain drilling parameters to estimate a pressure gradient for formation pore pressure evaluation while drilling) or MDT (Modular Formation Dynamics, a wireline formation testing tool, providing measurements of formation pore pressure). The data from the offset wells may be used to train and optimize a machine learning model. Next the mud gas data from the closest well may be used as input to the machine learning model to predict a formation pore pressure for the prospect at log scale; and (2) When the prospect starts drilling, real-time data of liberated gas may be used be used to update the formation pore pressure prediction at regular intervals. A detailed description is subsequently provided.

Embodiments of the disclosure provide various benefits. Embodiments of the disclosure address the challenge of formation pore pressure prediction. A non-seismic alternative to pre-drill formation pore pressure prediction that utilizes mud gas and MDT data is provided. Availability of the formation pore pressure prediction prior to and while drilling provides various benefits: The weight on the drill bit may be dynamically adjusted to prevent various drilling issues such as blowout, gas kicks, stuck pipe, fluid influx, and lost circulation, thereby increasing safety and increasing drilling efficiency. The drilling mud properties such as density and rheology may be dynamically adjusted, thereby increasing the rate of penetration. Availability of formation pore pressure predictions may further be beneficial or essential for well control, geosteering, to dynamically determine optimal casing points while drilling, to dynamically detect zones of poor quality logging while drilling (LWD) measurements, to dynamically detect zones of hydrocarbon existence, etc.

Embodiments of the disclosure overcome the limitation of the traditional approach to formation pore pressure prediction ahead of drilling a prospect. The traditional approach is based on seismic and wireline data. Seismic data has limitations which include low vertical resolution and high uncertainty. Further, wireline data is only available after drilling is completed. Embodiments of the disclosure utilize surface drilling parameters and mud gas data from offset wells to predict a log scale formation pore pressure profile to be included in the drilling plan. The prognostic may be updated in real time when drilling starts, using the same input data acquired while drilling. Embodiments of the disclosure may improve the accuracy and reduce the uncertainty of the formation pore pressure prediction as it is driven by geological data and the nonlinear approximation capability of machine learning.

Turning to FIG. 1, FIG. 1 shows a drilling system (100) that may include a top drive drilling rig (110) arranged around the setup of a drill bit logging tool (120). A top drive drilling rig (110) may include a top drive (111) that may be suspended in a derrick (112) by a travelling block (113). In the center of the top drive (111), a drive shaft (114) may be coupled to a top pipe of a drill string (115), for example, by threads. The top drive (111) may rotate the drive shaft (114), so that the drill string (115) and a drill bit logging tool (120) cut the rock at the bottom of a wellbore (116). A power cable (117) supplying electric power to the top drive (111) may be protected inside one or more service loops (118) coupled to a control system (144). As such, drilling mud may be pumped into the wellbore (116) through a mud line (119), the drive shaft (114), and/or the drill string (115).

The control system (144) may include one or more programmable logic controllers (PLCs) that include hardware and/or software with functionality to control one or more processes performed by the drilling system (100). Specifically, a programmable logic controller may control valve states, fluid levels, pipe pressures, warning alarms, and/or pressure releases throughout a drilling rig. In particular, a programmable logic controller may be a ruggedized computer system with functionality to withstand vibrations, extreme temperatures, wet conditions, and/or dusty conditions, for example, around a drilling rig. For example, the control system (144) may be coupled to the sensor assembly (123) in order to perform various program functions for up-down steering and left-right steering of the drill bit (124) through the wellbore (116). While one control system is shown in FIG. 1, the drilling system (100) may include multiple control systems for managing various well drilling operations, maintenance operations, well completion operations, and/or well intervention operations. The control system (144) may be based on a computer system as shown FIG. 5.

The wellbore (116) may include a bored hole that extends from the surface into a target zone of the hydrocarbon-bearing formation, such as the reservoir. An upper end of the wellbore (116), terminating at or near the surface, may be referred to as the "up-hole" end of the wellbore (116), and a lower end of the wellbore, terminating in the hydrocarbon-bearing formation, may be referred to as the "down-hole" end of the wellbore (116). The wellbore (116) may facilitate the circulation of drilling fluids during well drilling operations, the flow of hydrocarbon production ("production") (e.g., oil and gas) from the reservoir to the surface during production operations, the injection of substances (e.g., water) into the hydrocarbon-bearing formation or the reservoir during injection operations, or the communication of monitoring devices (e.g., logging tools) into the hydrocarbon-bearing formation or the reservoir during monitoring operations (e.g., during in situ logging operations). In one or more embodiments, a mud line (119) connects to a drilling fluid circulation system (not shown). A gas mixture may be separated from the drilling mud circulated via the mud line (119). The gas mixture may be analyzed by various instruments such as a gas mass spectrometer (not shown) and/or a gas chromatograph (not shown) in order to acquire mud gas parameters.

As further shown in FIG. 1, sensors (121) may be included in a sensor assembly (123), which is positioned adjacent to a drill bit (124) and coupled to the drill string (115). Sensors (121) may also be coupled to a processor assembly (123) that includes a processor, memory, and an analog-to-digital converter (122) for processing sensor measurements. For example, the sensors (121) may include acoustic sensors, such as accelerometers, measurement microphones, contact microphones, and hydrophones. Likewise, the sensors (121) may include other types of sensors, such as transmitters and receivers to measure resistivity, gamma ray detectors, etc. The sensors (121) may include hardware and/or software for generating different types of well logs (such as acoustic logs or sonic logs) that may provide well data about a wellbore, including porosity of wellbore sections, gas saturation, bed boundaries in a geologic formation, fractures in the wellbore or completion cement, and many other pieces of information about a formation. If such well data is acquired during well drilling operations (i.e., logging-while-drilling (LWD)), then the information may be used to make adjustments to drilling operations in real-time. Such adjustments may include rate of penetration (ROP), drilling direction, altering mud weight, and many others drilling parameters.

One or more of the drilling parameters, including drilling surface parameters, and mud gas parameters may be used for the prediction of formation pore pressure for the prospect. The surface drilling parameters may include, but are not limited to, the rate of penetration (ROP), the weight on bit (WOB), the torque, the revolutions per minute (RPM), the hook load, the mud flow rate, the D-exponent, the mud density, the standpipe pressure, and/or the mud temperature. The mud gas parameters may capture different gas components ranging from the light (C1, C2, C2S, C3, iC4, nC4, iC5, nC5) to the heavy (Benzene, Toluene, Helium, MethylCycloHexane) gas components as well as the organic (all the afore-mentioned) and inorganic (CO2, H2, H2S) gas components.

One or more components of the drilling system (100) may be part of a system for formation pore pressure prediction prior to and during drilling. Specifically, the drilling system (100) may be an offset well or the prospect, as further described below in reference to the subsequently discussed figures. A processing system (150), may receive data from the drilling system (100) and, if the drilling system is the prospect, may further issue drilling commands to the drilling system (100). The processing system (150) may include a computing system such as the computer system shown in FIG. 5. The computing system may be the control system (144) or any other computing system. The computing system, in one or more embodiments, performs the methods shown in FIGS. 4A and/or 4B.

Keeping with FIG. 1, when completing a well, one or more well completion operations may be performed prior to delivering the well to the party responsible for production or injection. Well completion operations may include casing operations, cementing operations, perforating the well, gravel packing, directional drilling, hydraulic and acid stimulation of a reservoir region, and/or installing a production tree or wellhead assembly at the wellbore (116). Likewise, well operations may include open-hole completions or cased-hole completions. For example, an open-hole completion may refer to a well that is drilled to the top of the hydrocarbon reservoir. Thus, the well is cased at the top of the reservoir, and left open at the bottom of a wellbore. In contrast, cased-hole completions may include running casing into a reservoir region. Cased-hole completions are discussed further below with respect to perforation operations.

In one well operation example, the sides of the wellbore (116) may require support, and thus casing may be inserted into the wellbore (116) to provide such support. After a well has been drilled, casing may ensure that the wellbore (116) does not close in upon itself, while also protecting the wellstream from outside incumbents, like water or sand. Likewise, if the formation is firm, casing may include a solid string of steel pipe that is run on the well and will remain that way during the life of the well. In some embodiments, the casing includes a wire screen liner that blocks loose sand from entering the wellbore (116).

In another well operation example, a space between the casing and the untreated sides of the wellbore (116) may be cemented to hold a casing in place. This well operation may include pumping cement slurry into the wellbore (116) to displace existing drilling fluid and fill in this space between the casing and the untreated sides of the wellbore (116). Cement slurry may include a mixture of various additives and cement. After the cement slurry is left to harden, cement may seal the wellbore (116) from non-hydrocarbons that attempt to enter the wellstream. In some embodiments, the cement slurry is forced through a lower end of the casing and into an annulus between the casing and a wall of the wellbore (116). More specifically, a cementing plug may be used for pushing the cement slurry from the casing. For example, the cementing plug may be a rubber plug used to separate cement slurry from other fluids, reducing contamination and maintaining predictable slurry performance. A displacement fluid, such as water, or an appropriately weighted drilling fluid, may be pumped into the casing above the cementing plug. This displacement fluid may be pressurized fluid that serves to urge the cementing plug downward through the casing to extrude the cement from the casing outlet and back up into the annulus.

Keeping with well operations, some embodiments include perforation operations. More specifically, a perforation operation may include perforating casing and cement at different locations in the wellbore (116) to enable hydrocarbons to enter a wellstream from the resulting holes. For example, some perforation operations include using a perforation gun at different reservoir levels to produce holed sections through the casing, cement, and sides of the wellbore (116). Hydrocarbons may then enter the wellstream through these holed sections. In some embodiments, perforation operations are performed using discharging jets or shaped explosive charges to penetrate the casing around the wellbore (116).

In another well operation, a filtration system may be installed in the wellbore (116) in order to prevent sand and other debris from entering the wellstream. For example, a gravel packing operation may be performed using a gravel-packing slurry of appropriately sized pieces of coarse sand or gravel. As such, the gravel-packing slurry may be pumped into the wellbore (116) between a casing's slotted liner and the sides of the wellbore (116). The slotted liner and the gravel pack may filter sand and other debris that might have otherwise entered the wellstream with hydrocarbons.

In some embodiments, well intervention operations may include various operations carried out by one or more service entities for an oil or gas well during its productive life (e.g., fracking operations, CT, flow back, separator, pumping, wellhead and Christmas tree maintenance, slickline, wireline, well maintenance, stimulation, braded line, coiled tubing, snubbing, workover, subsea well intervention, etc.). For example, well intervention activities may be similar to well completion operations, well delivery operations, and/or drilling operations in order to modify the state of a well or well geometry. In some embodiments, well intervention operations provide well diagnostics, and/or manage the production of the well. With respect to service entities, a service entity may be a company or other actor that performs one or more types of oil field services, such as well operations, at a well site. For example, one or more service entities may be responsible for performing a cementing operation in the wellbore (116) prior to delivering the well to a producing entity.

While FIG. 1 shows various configurations of components, other configurations may be used without departing from the scope of the disclosure. For example, various components in FIG. 1 may be combined to create a single component. As another example, the functionality performed by a single component may be performed by two or more components.

Figure 2:
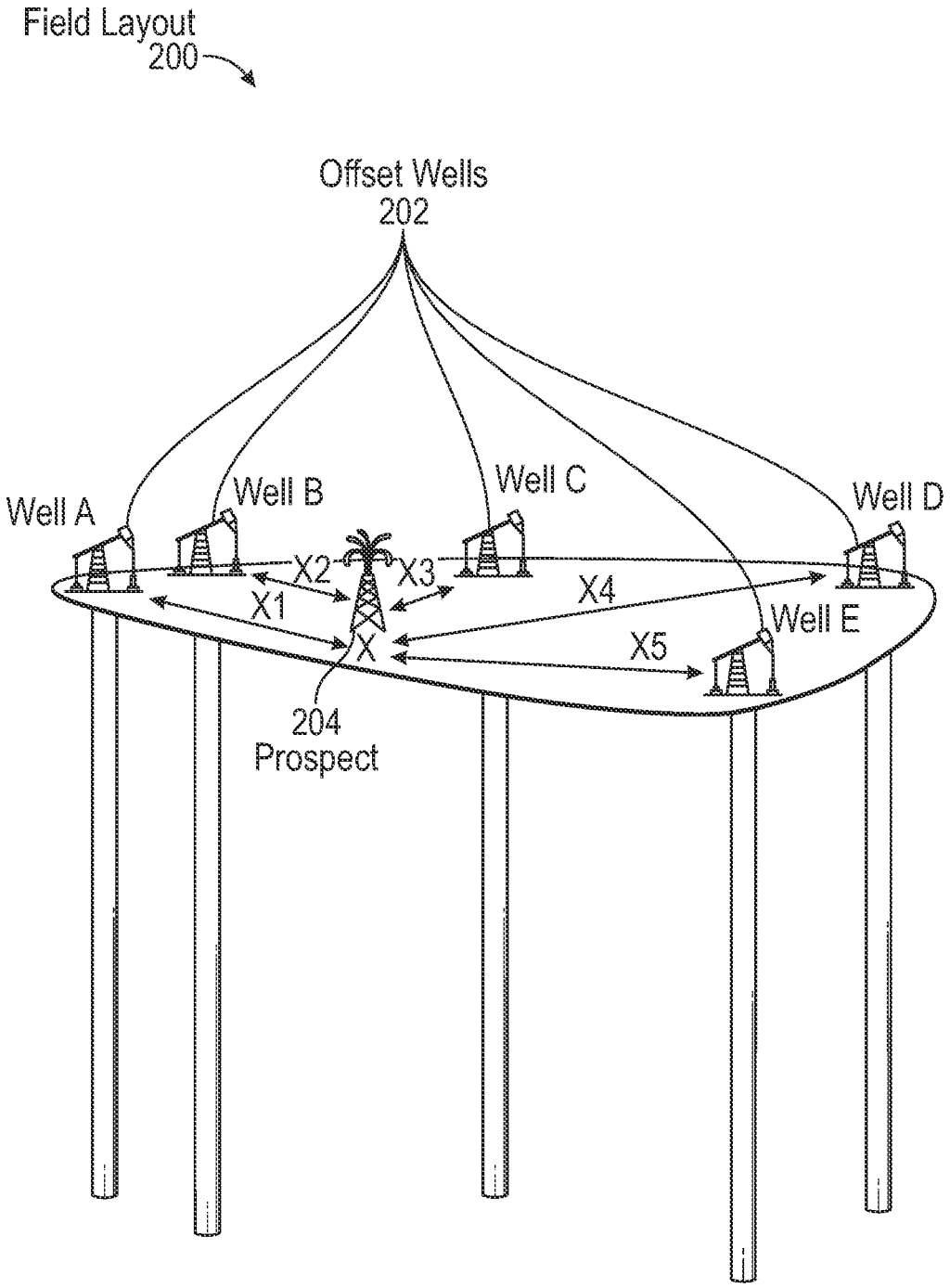
FIG. 2 shows a field layout including offset wells and a prospect, in accordance with one or more embodiments.

FIG. 2 shows a field layout (200) including offset wells (202) and a prospect (204), in accordance with one or more embodiments. The prospect (204) is a new well planned to be drilled, e.g., as described in reference to FIG. 1. Embodiments of the disclosure facilitate the drilling of the prospect (202) by providing formation pore pressure predictions prior to and during the drilling of the prospect (204). The offset wells (202) are existing wells, e.g., as described in reference to FIG. 1, located in the area of the prospect (204). Data gathered from the offset wells (202) may be used to make formation pore pressure predictions for the prospect (204), as subsequently described. In the field layout (200), five offset wells (202) are shown, at distances $x_1$-$x_5$ away from the prospect (204). The offset well C is closest to the prospect (204), and the offset well D is most distant from the prospect (204).

Figure 3A:
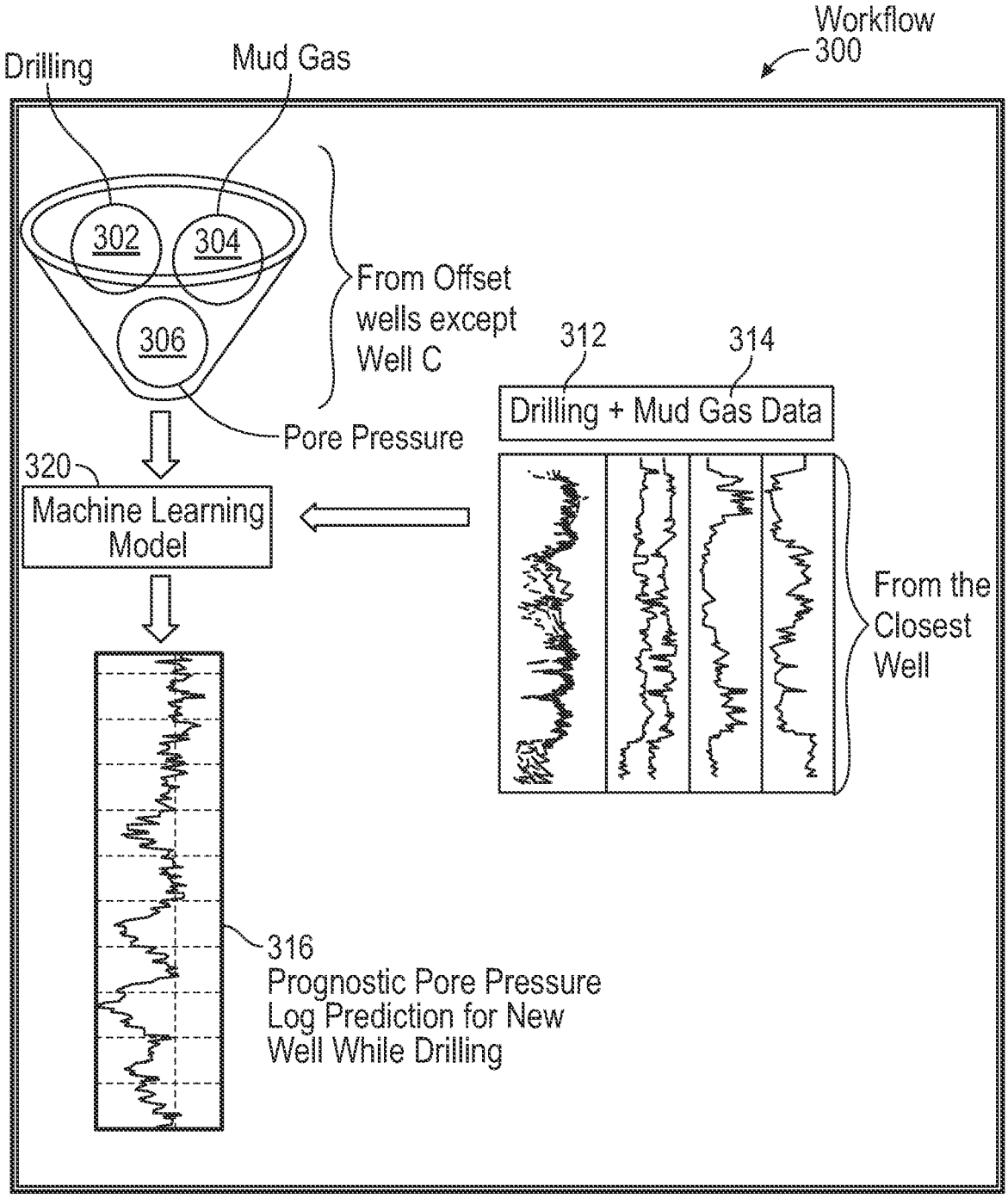
FIG. 3A shows a workflow for generating a formation pore pressure log prediction for a prospect, in accordance with one or more embodiments.

FIG. 3A shows a workflow (300) for generating a formation pore pressure prediction for a prospect, in accordance with one or more embodiments. Initially, prior to the operations illustrated in FIG. 3, the location of a prospect (i.e., the new well planned to be drilled) is identified. An example is provided in FIG. 2. Next, the surface drilling parameters (302) and mud gas data (304) from offset wells are collected along with their respective formation pore pressure values (306). Optionally, logging while drilling (LWD) data, e.g., gamma ray data, may also be collected. Numerous samples may be available at different depths from each of the offset wells. The formation pore pressure values (306) may be those calculated from equations such as the D-Exponent (an extrapolation of certain drilling parameters to estimate a pressure gradient for formation pore pressure evaluation while drilling) or measured during well testing processes such as the Modular Formation Dynamics (MDT, a wireline formation testing tool, providing measurements of formation pore pressure). The latter may be more accurate but usually scanty as only few samples are taken from specific zones of interest in a reservoir for analysis. From the offset wells, a closest one to the prospect in terms of proximity or geology is identified. For example, in FIG. 2 the closest offset well is well C. As illustrated in FIG. 3, the surface drilling parameters (302), mud gas data (304), and formation pore pressure data (306) are collected from offset wells (although the data from the closest offset well may be excluded). These data may be used to train and optimize a machine learning (ML) model (320). Next, only the drilling parameters (312) and mud gas data (314) and optionally the LWD data (without the pore pressure) from the closest well may be used as input to the model (320) to predict a formation pore pressure profile (316). The formation pore pressure profile (316), in one or more embodiments, is a log of pore pressure values for different depths. The formation pore pressure profile for a well is the set of pore pressure estimated, calculated, and/or measured over an interval of interest. Hence, the spatial resolution would depend on the data used to calibrate it or the interval of sampling. For example, when calibrated with sonic and resistivity logs, the formation pore pressure assumes the log resolution of 0.5 ft. When measured on samples, it may become irregular. A more detailed description of the operations of the workflow (300) is provided below in the flowchart of FIG. 4A.

Figure 3B:
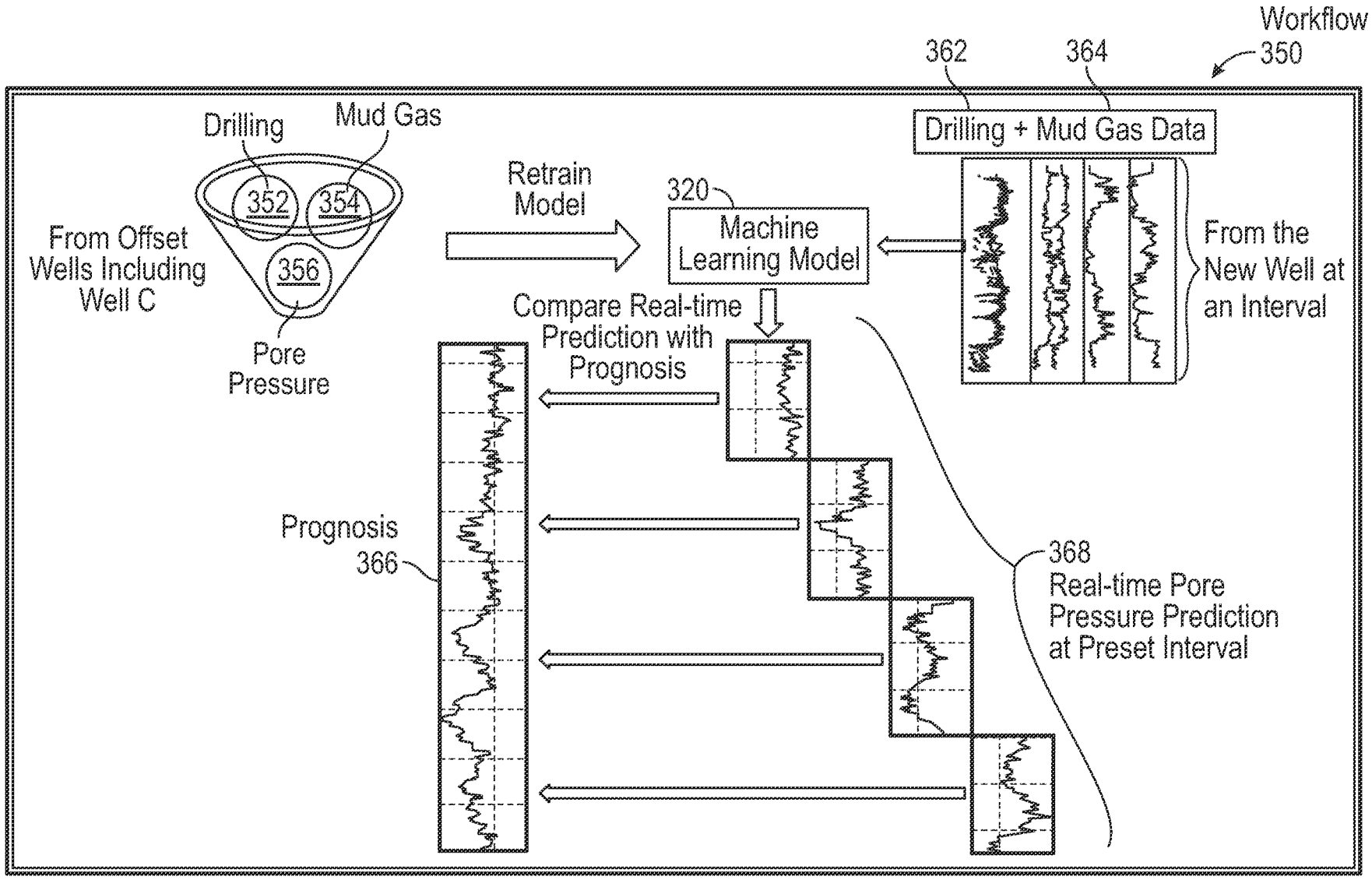
FIG. 3B shows a workflow for updating the formation pore pressure log prediction during the drilling of the prospect.

FIG. 3B shows a workflow (350) for an updating of the formation pore pressure profile during the drilling of the prospect. The complete data (surface drilling parameters (352), mud gas data (354), formation pore pressure data (356)), including the data for well C, are included in the training database and may be used to retrain the ML model (320). Including the signatures of well C in the training database may improve the prediction of real-time formation pore pressure (366) while drilling. When the prospect starts drilling, the surface drilling parameters (362) and mud gas data (364) that are acquired in real time are used as input to the retrained model (320) to predict a more realistic formation pore pressure (368). The real-time formation pore pressure predictions (368) may be compared with the formation pore pressure profile prediction (366), and the difference, if any, may be used to adjust the formation pore pressure profile prediction (366) beyond the drill bit. The formation pore pressure profile prediction (366) may be analyzed to determine possible cases of under- or overpressure using a threshold. The relevant flag may be raised through an alert system to indicate the imminent condition.

Figure 4A:
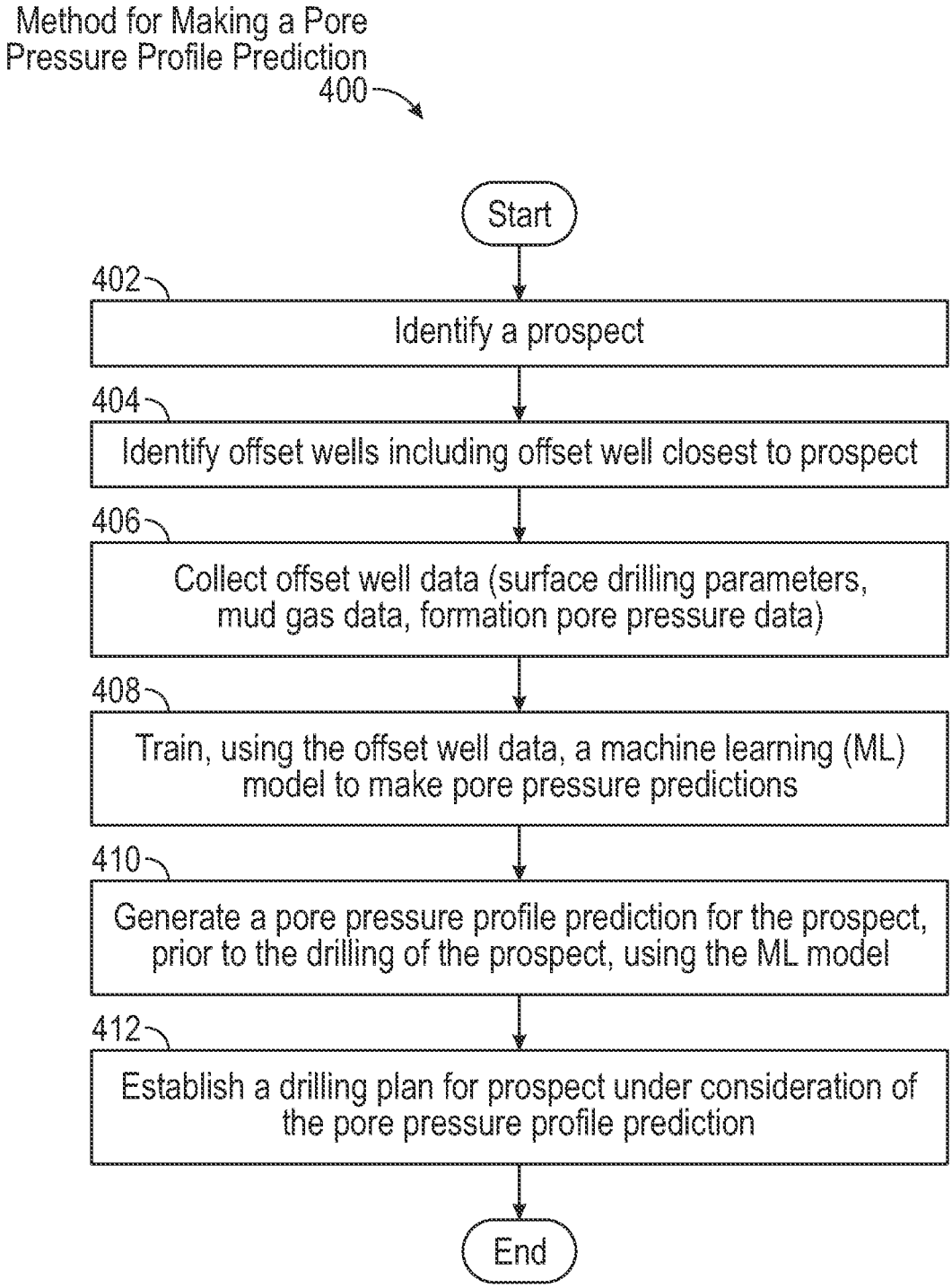
FIG. 4A shows a flowchart of a method for making a formation pore pressure profile prediction, in accordance with one or more embodiments.
Figure 4B:
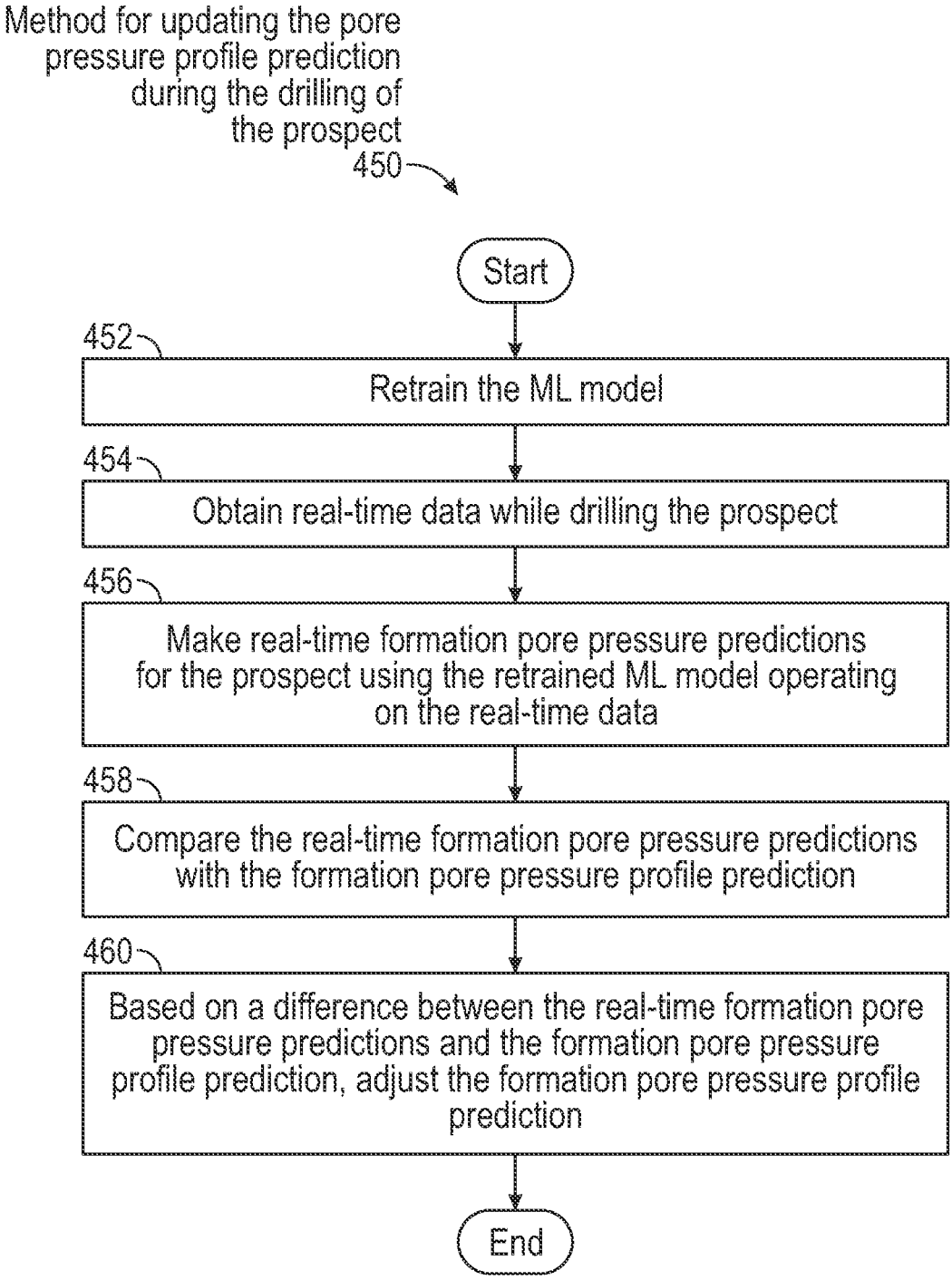
FIG. 4B shows a flowchart of a method for updating the formation pore pressure profile prediction during the drilling of the prospect, in accordance with one or more embodiments.

FIGS. 4A and 4B show flowcharts in accordance with one or more embodiments. FIG. 4A shows a method for making a formation pore pressure profile prediction, in accordance with one or more embodiments, and FIG. 4B shows a method for updating the formation pore pressure profile prediction during the drilling of the prospect, in accordance with one or more embodiments.

Execution of one or more blocks in FIGS. 4A and 4B may involve one or more components of the system as described in FIGS. 1 and 2. While the various blocks in FIGS. 4A and 4B are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Turning to FIG. 4A, the method (400), in one or more embodiments, determines a formation pore pressure profile prediction for a prospect.

In Step 402, the prospect is identified. Identification of the prospect may involve determining a location of the prospect. Any location may be selected. The location may be selected based on any consideration such an expected productivity of the well to be drilled.

In Step 404, offset wells associated with the prospect are identified. An offset well associated with the prospect, in one or more embodiments, is an existing well in proximity to the prospect. For example, if multiple wells are existing in an area surrounding or adjacent to the prospect, the wells that are in closest spatial or geological proximity to the prospect are selected as offset wells associated with the prospect, based on the assumption that an offset well in closer proximity to the prospect may have formation pore pressure characteristics similar to the prospect. Among the offset wells, the offset well with the closest proximity to the prospect is identified.

In Step 406, offset well data are obtained for the offset wells. The offset well data may include surface drilling parameters, mud gas data, and formation pore pressure data, as previously described. The offset well data may be stored in any format, e.g., in a database.

In Step 408, a machine learning (ML) model is trained to make pore pressure predictions.

The ML model may be any type of machine learning model. Examples for machine learning models that may be used include, but are not limited to, Artificial Neural Networks (ANN), Support Vector Machines (SVM), Regression Trees (RT), Random Forests (RF), Extreme Learning Machines (ELM), Type I and Type II Fuzzy Logic (T1FL/T2FL), etc. Although the following description is based on the use of an ANN, the same principles may be applied to the other algorithms. In some embodiments, two or more different types of machine-learning models are integrated into a single machine-learning architecture, e.g., a machine-learning model may include support vector machines and neural networks.

In some embodiments, various types of machine learning algorithms, e.g., backpropagation algorithms, may be used to train the machine learning models. In a backpropagation algorithm, gradients are computed for each hidden layer of a neural network in reverse from the layer closest to the output layer proceeding to the layer closest to the input layer. As such, a gradient may be calculated using the transpose of the weights of a respective hidden layer based on an error function (also called a "loss function"). The error function may be based on various criteria, such as mean squared error function, a similarity function, etc., where the error function may be used as a feedback mechanism for tuning weights in the machine-learning model. In some embodiments, historical data, e.g., production data recorded over time may be augmented to generate synthetic data for training a machine learning model.

With respect to neural networks, for example, a neural network may include one or more hidden layers, where a hidden layer includes one or more neurons. A neuron may be a modelling node or object that is loosely patterned on a neuron of the human brain. In particular, a neuron may combine data inputs with a set of coefficients, i.e., a set of network weights for adjusting the data inputs. These network weights may amplify or reduce the value of a particular data input, thereby assigning an amount of significance to various data inputs for a task being modeled. Through machine learning, a neural network may determine which data inputs should receive greater priority in determining one or more specified outputs of the neural network. Likewise, these weighted data inputs may be summed such that this sum is communicated through a neuron's activation function to other hidden layers within the neural network. As such, the activation function may determine whether and to what extent an output of a neuron progresses to other neurons where the output may be weighted again for use as an input to the next hidden layer.

In one embodiment, the ANN model used in Step 408 is configured and optimized with one or more hidden layers (depending on the volume and complexity of the training data), a sigmoid activation function in the hidden layer, a linear function in the summation layer, and training algorithms based on the Levenberg-Marquardt and Bayesian regulation backpropagation. The training of Step 408 may further involve adjusting model parameters, such as the learning rate, number of neurons, activation function, and weight coefficients to their optimal values. The error (residual, mean, absolute, or percentage) between the model prediction and the actual pore pressure data may be kept within a pre-set range. If the error is within the range, the model may be considered optimized and may receive real-time data from the new well to predict the pore pressure log profile. Otherwise, the training operations of Step 408 may continue. The process of matching the model prediction with the actual pore pressure data is performed in a feed-forward manner, and the process of re-adjusting the model parameters to increase the match and reduce the error between the model prediction and the actual pore pressure data is performed as a back-propagation process. The combined execution of the feedforward and back-propagation processes may remove the bias embedded in the original pore pressure estimations by the ML model. Step 408 may be executed in iterations until the error is within the preset range or a maximum number of iterations is reached. The best model achieved at that point may be used in the subsequent steps. The following paragraphs provide additional details on the training being performed in Step 408.

The training may be performed using the offset well data, in order to obtain an ML model that establishes a relationship between the combined surface drilling parameters and mud gas data at the input of the ML model and the formation pore pressure at the output of the ML model. In one or more embodiments, the offset well data used for the training excludes the offset well data associated with the offset well in closest proximity to the prospect.

First, the offset well data, obtained in Step 406, is split into a training subset and a validation subset. The training and validation data subsets are used to create a nonlinear mathematical relationship between the combined data and the pore pressure estimations, represented by the ML model. The training involves assigning a certain weight factor determined by the outcome of the nonlinear mapping using an appropriate activation function to each feature from the combined data. This weight factor, typically ranging from 0 to ±1, may be obtained from the degree of nonlinear correlation or significance between the combined data (surface drilling parameters and mud gas data) and the pore pressure data. The weighting process may determine the effect a variable from the combined input data has on the overall relationship provided by the ML model being trained. A certain function, $f$, such as a sigmoid may be used to transform the input space to a high-dimensional nonlinear space to match the nature of the subsurface data. In a simplified form, a typical mathematical equation could be as shown in a very much simplified form below:

$$Y = f(a_1X_1 + a_2X_2 + \ldots + a_6X_6).$$

Y is the target variable (pore pressure in this case), $a_1 \ldots a_6$ are the weighting factors, $X_1$-$X_6$ are examples of the combined input data, and $f$ is the activation function such as Gaussian or sigmoid.

A Gaussian function is in this form:

$$f(x) = e^{-x^2},$$

where x is each of the input wireline logs.

A sigmoid function is in this form:

$$f(x) = \frac{1}{1 + e^{-x}},$$

where x is each of the input wireline logs.

Parameters such as the number of layers and number of neurons in the hidden layer(s) are set to fit the nonlinear equation to the training data.

The input part of the validation dataset (combined data) may be passed to the ML model being trained, while keeping the target values (actual pore pressure) hidden. The ML model being trained is used to estimate the target values corresponding to the combined input data of the validation data set. The estimated target values are then compared to the actual target values of the validation data set, kept hidden from the ML model being. If the residual is more than a predefined threshold, the parameters are updated, and the entire process is repeated. The described cycle may be continued until the residual is within the predefined threshold. At this point, the ML model may be considered trained and ready for predicting the formation pore pressure for the prospect, as discussed below.

In Step 410, a pore pressure profile prediction is generated for the prospect. The pore pressure profile prediction may include predicted pore pressure values for different depths of the prospect. The pore pressure profile prediction may be for the entire well depth to be drilled, for a zone of interest, or for a zone for which inputs to the ML model are available. In one or more embodiments, the pore pressure profile prediction is generated prior to the drilling of the prospect. The pore pressure profile prediction may be produced by the ML model, after the training of Step 408. The input to the ML model, when making the prediction, in one or more embodiments, is the offset well data of the offset well determined to be in closest proximity to the prospect. Based on the close proximity of the offset well to the prospect, the pore pressure profile prediction of Step 410 may reflect the actual pore pressure profile of the prospect with reasonable accuracy.

In Step 412, a drilling plan is established for the prospect. Establishing the drilling plan may include setting the surface drilling parameters (e.g., the parameters discussed in reference to FIG. 1), such that drilling issues such as a blowout, gas kicks, a stuck pipe, fluid influx, and/or lost circulation are avoided, thereby increasing safety and increasing drilling efficiency. For example, the weight on bit may be dynamically adjusted based on the drilling plan to prevent the described drilling issues.

Turning to FIG. 4B, the method (450) updates the formation pore pressure profile prediction during the drilling of the prospect, in accordance with one or more embodiments of the disclosure. The method of FIG. 4B may be executed after the execution of the method of FIG. 4A has been completed. For example, the method of FIG. 4B may be executed while the prospect is being drilled according to the drilling plan established in Step 412.

In Step 452, the ML model is retrained. The retraining may be performed analogous to the initial training (Step 408), although including the offset well data of the offset well in closest proximity to the prospect. The retraining is optional and may be performed for any additional offset well for which offset well data become available. The retraining may result in an ML model different from the original machine learning model. For example, gains may be different, tuning parameters such as the number of neurons, the number of layers, etc. may be different.

In Step 454, real-time data is obtained as the input to the retrained ML model. The real-time data may be obtained during the ongoing drilling of the prospect. The real-time data may include the current surface drilling parameters and mud gas data of the prospect, during the ongoing drilling. The real-time data may be obtained at regular depth intervals, as the drilling is progressing, e.g., as described in reference to FIG. 1.

In Step 456, real-time formation pore pressure predictions are made for the prospect using the retrained ML model applied to the real-time data obtained in Step 454. The real-time formation pore pressure predictions may be made at the depth intervals at which real-time data was obtained.

In Step 458, the real-time formation pore pressure predictions obtained in Step 456 are compared with the formation pore pressure profile prediction obtained in Step 410. The comparison may be performed for the corresponding depth intervals. The real-time formation pore pressure predictions may further be compared against pre-specified thresholds to determine possible cases of under- or over-pressure. An alert may be issued to indicate the imminent condition.

In Step 460, based on a difference between the real-time formation pore pressure predictions and the formation pore pressure profile prediction, the formation pore pressure profile prediction is adjusted. More specifically, the formation pore pressure profile prediction may be adjusted for the depth intervals below the current depth interval. The adjustment may be performed by replacing the estimated pore pressure with the real-time actual prediction since the latter is considered more accurate than the former. The former was estimated as a prognosis due to the absence of the latter. As soon as the latter is obtained, the replacement may be performed.

Figure 5:
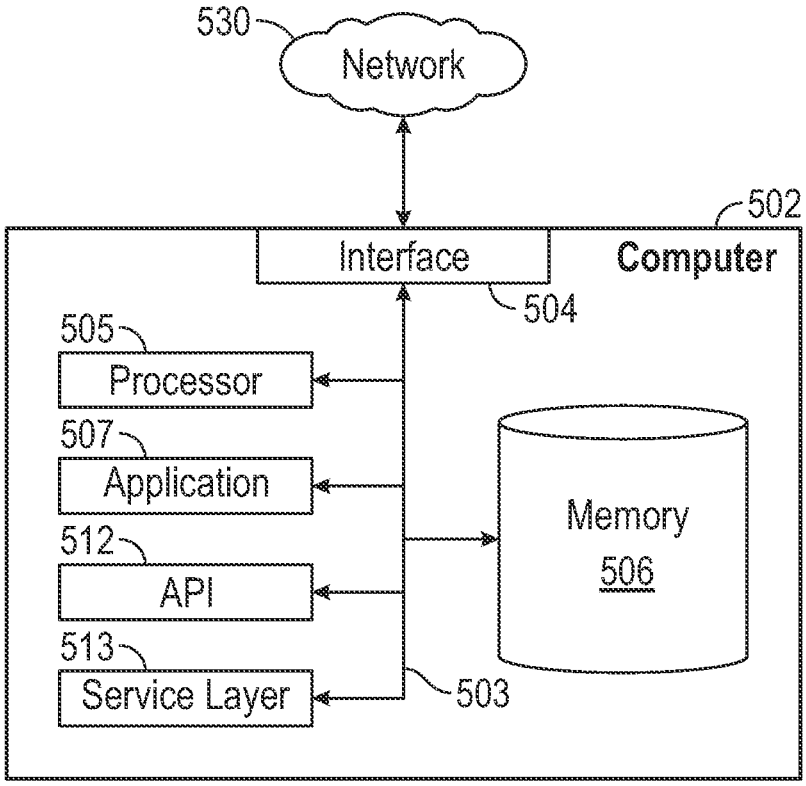
FIG. 5 shows a computer system in accordance with one or more embodiments.

Embodiments may be implemented on a computer system. FIG. 5 is a block diagram of a computer system (502) used to provide computational functionalities associated with described algorithms, methods, functions, processes, flows, and procedures as described in the instant disclosure, according to an implementation. The illustrated computer (502) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (502) may include a computer that includes an input device, such as a keypad, keyboard, touch screen, or other device that can accept user information, and an output device that conveys information associated with the operation of the computer (502), including digital data, visual, or audio information (or a combination of information), or a GUI.

The computer (502) can serve in a role as a client, network component, a server, a database or other persistency, or any other component (or a combination of roles) of a computer system for performing the subject matter described in the instant disclosure. The illustrated computer (502) is communicably coupled with a network (530). In some implementations, one or more components of the computer (502) may be configured to operate within environments, including cloud-computing-based, local, global, or other environment (or a combination of environments).

At a high level, the computer (502) is an electronic computing device operable to receive, transmit, process, store, or manage data and information associated with the described subject matter. According to some implementations, the computer (502) may also include or be communicably coupled with an application server, e-mail server, web server, caching server, streaming data server, business intelligence (BI) server, or other server (or a combination of servers).

The computer (502) can receive requests over network (530) from a client application (for example, executing on another computer (502)) and responding to the received requests by processing the said requests in an appropriate software application. In addition, requests may also be sent to the computer (502) from internal users (for example, from a command console or by other appropriate access method), external or third-parties, other automated applications, as well as any other appropriate entities, individuals, systems, or computers.

Each of the components of the computer (502) can communicate using a system bus (503). In some implementations, any or all of the components of the computer (502), both hardware or software (or a combination of hardware and software), may interface with each other or the interface (504) (or a combination of both) over the system bus (503) using an application programming interface (API) (512) or a service layer (513) (or a combination of the API (512) and service layer (513). The API (512) may include specifications for routines, data structures, and object classes. The API (512) may be either computer-language independent or dependent and refer to a complete interface, a single function, or even a set of APIs. The service layer (513) provides software services to the computer (502) or other components (whether or not illustrated) that are communicably coupled to the computer (502). The functionality of the computer (502) may be accessible for all service consumers using this service layer. Software services, such as those provided by the service layer (513), provide reusable, defined business functionalities through a defined interface. For example, the interface may be software written in JAVA, C++, or other suitable language providing data in extensible markup language (XML) format or other suitable format. While illustrated as an integrated component of the computer (502), alternative implementations may illustrate the API (512) or the service layer (513) as stand-alone components in relation to other components of the computer (502) or other components (whether or not illustrated) that are communicably coupled to the computer (502). Moreover, any or all parts of the API (512) or the service layer (513) may be implemented as child or sub-modules of another software module, enterprise application, or hardware module without departing from the scope of this disclosure.

The computer (502) includes an interface (504). Although illustrated as a single interface (504) in FIG. 5, two or more interfaces (504) may be used according to particular needs, desires, or particular implementations of the computer (502). The interface (504) is used by the computer (502) for communicating with other systems in a distributed environment that are connected to the network (530). Generally, the interface (504) includes logic encoded in software or hardware (or a combination of software and hardware) and operable to communicate with the network (530). More specifically, the interface (504) may include software supporting one or more communication protocols associated with communications such that the network (530) or interface's hardware is operable to communicate physical signals within and outside of the illustrated computer (502).

The computer (502) includes at least one computer processor (505). Although illustrated as a single computer processor (505) in FIG. 5, two or more processors may be used according to particular needs, desires, or particular implementations of the computer (502). Generally, the computer processor (505) executes instructions and manipulates data to perform the operations of the computer (502) and any algorithms, methods, functions, processes, flows, and procedures as described in the instant disclosure.

The computer (502) also includes a memory (506) that holds data for the computer (502) or other components (or a combination of both) that can be connected to the network (530). For example, memory (506) can be a database storing data consistent with this disclosure. Although illustrated as a single memory (506) in FIG. 5, two or more memories may be used according to particular needs, desires, or particular implementations of the computer (502) and the described functionality. While memory (506) is illustrated as an integral component of the computer (502), in alternative implementations, memory (506) can be external to the computer (502).

The application (507) is an algorithmic software engine providing functionality according to particular needs, desires, or particular implementations of the computer (502), particularly with respect to functionality described in this disclosure. For example, application (507) can serve as one or more components, modules, applications, etc. Further, although illustrated as a single application (507), the application (507) may be implemented as multiple applications (507) on the computer (502). In addition, although illustrated as integral to the computer (502), in alternative implementations, the application (507) can be external to the computer (502).

There may be any number of computers (502) associated with, or external to, a computer system containing computer (502), each computer (502) communicating over network (530). Further, the term "client," "user," and other appropriate terminology may be used interchangeably as appropriate without departing from the scope of this disclosure. Moreover, this disclosure contemplates that many users may use one computer (502), or that one user may use multiple computers (502).

In some embodiments, the computer (502) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method for facilitating drilling of a prospect, the method comprising:

for a plurality of offset wells associated with the prospect, obtaining offset well data, the offset well data comprising:

surface drilling parameters, mud gas data, and formation pore pressure data;

training, using the offset well data, a machine learning (ML) model to make formation pore pressure predictions, wherein the offset well data used for training the ML model excludes the offset well data of an offset well in closest proximity to the prospect; and generating a formation pore pressure profile prediction for the prospect prior to drilling the prospect by:

making formation pore pressure predictions for the offset well in closest proximity to the prospect using the ML model operating on the offset well data of the offset well in closest proximity to the prospect;

establishing a drilling plan for the prospect under consideration of the formation pore pressure profile prediction;

drilling the prospect according to the drilling plan;

generating real-time formation pore pressure predictions for the prospect using the ML model operating on real-time data associated with the ongoing drilling of the prospect;

determining a difference between the real-time formation pore pressure predictions and the formation pore pressure profile prediction;

based on the difference, adjusting the formation pore pressure profile prediction; and based on the adjustment of the formation pore pressure profile prediction, adjusting the drilling of the prospect.

2. The method of claim 1, wherein the closest proximity is determined based on at least one selected from a group consisting of a spatial proximity and a geological proximity.

3. The method of claim 1, wherein the formation pore pressure profile prediction comprises pore pressure estimates for the prospect at different depths within a depth interval of interest.

4. The method of claim 1, further comprising:

retraining the ML model using the offset well data including the offset well data of the offset well in closest proximity to the prospect.

5. The method of claim 1, further comprising:

comparing the real-time formation pore pressure predictions against pre-specified thresholds to determine a possible imminent condition of under-pressure or over-pressure, during the drilling of the prospect; and issuing an alert to indicate the imminent condition.

6. The method of claim 1, wherein the ML model is one selected from a group consisting of an Artificial Neural Network, a Support Vector Machine, a Regression Tree, a Random Forest, an Extreme Learning Machine, a Type I Fuzzy Logic, and a Type II Fuzzy Logic.

7. A non-transitory machine-readable medium comprising a plurality of machine-readable instructions executed by one or more processors, the plurality of machine-readable instructions causing the one or more processors to perform operations comprising:

for a plurality of offset wells associated with a prospect, obtaining offset well data, the offset well data comprising:

surface drilling parameters, mud gas data, and formation pore pressure data;

training using the offset well data, a machine learning (ML) model to make formation pore pressure predictions, wherein the offset well data used for training the ML model excludes the offset well data of an offset well in closest proximity to the prospect; and generating a formation pore pressure profile prediction for the prospect prior to drilling the prospect by:

making formation pore pressure predictions for the offset well in closest proximity to the prospect using the ML model operating on the offset well data of the offset well in closest proximity to the prospect;

establishing a drilling plan for the prospect under consideration of the formation pore pressure profile prediction;

drilling the prospect according to the drilling plan;

generating real-time formation pore pressure predictions for the prospect using the ML model operating on real-time data associated with the ongoing drilling of the prospect;

determining a difference between the real-time formation pore pressure predictions and the formation pore pressure profile prediction;

based on the difference, adjusting the formation pore pressure profile prediction; and based on the adjustment of the formation pore pressure profile prediction, adjusting the drilling of the prospect.

8. The non-transitory machine-readable medium of claim 7, wherein the closest proximity is determined based on at least one selected from a group consisting of a spatial proximity and a geological proximity.

9. The non-transitory machine-readable medium of claim 7, wherein the formation pore pressure profile prediction comprises pore pressure estimates for the prospect at different depths within a depth interval of interest.

10. The non-transitory machine-readable medium of claim 7, wherein the operations further comprise:

retraining the ML model using the offset well data including the offset well data of the offset well in closest proximity to the prospect.

11. The non-transitory machine-readable medium of claim 7, wherein the operations further comprise:

comparing the real-time formation pore pressure predictions against pre-specified thresholds to determine a possible imminent condition of under-pressure or over-pressure, during the drilling of the prospect; and issuing an alert to indicate the imminent condition.

12. The non-transitory machine-readable medium of claim 7, wherein the ML model is one selected from a group consisting of an Artificial Neural Network, a Support Vector Machine, a Regression Tree, a Random Forest, an Extreme Learning Machine, a Type I Fuzzy Logic, and a Type II Fuzzy Logic.

* * * * *